US005238364A

United States Patent [19]

Kreitmeier

[11] Patent Number: 5,238,364

[45] Date of Patent: Aug. 24, 1993

[54] SHROUD RING FOR AN AXIAL FLOW TURBINE

[75] Inventor: Franz Kreitmeier, Baden, Switzerland

[73] Assignee: Asea Brown Boveri Ltd., Baden, Switzerland

[21] Appl. No.: 916,709

[22] Filed: Jul. 22, 1992

[30] Foreign Application Priority Data

Aug. 8, 1991 [CH] Switzerland ..... 2349/91

[51] Int. Cl.[5] ..... F01D 11/02

[52] U.S. Cl. ..... 415/173.1; 415/173.6; 415/171.1

[58] Field of Search ..... 415/170.1, 171.1, 173.1, 415/173.6; 416/191

[56] References Cited

U.S. PATENT DOCUMENTS

| | | | |
|---|---|---|---|
| 2,910,269 | 10/1959 | Howorth et al. | 415/173.6 |
| 3,677,660 | 7/1972 | Taniguchi et al. | 415/173.6 |
| 3,876,330 | 4/1975 | Pearson et al. | 415/173.6 |
| 4,295,787 | 10/1981 | Lardellier | 415/173.6 |
| 4,370,094 | 1/1983 | Ambrosch et al. | 415/173.6 |
| 4,576,551 | 3/1986 | Olivier et al. | 415/173.6 |
| 4,623,298 | 11/1986 | Hallinger et al. | 415/173.6 |
| 4,662,820 | 5/1987 | Sasoda et al. | 415/173.6 |
| 4,710,102 | 12/1987 | Ortolano | 416/191 |

FOREIGN PATENT DOCUMENTS

| | | | |
|---|---|---|---|
| 0194957 | 6/1987 | European Pat. Off. . | |
| 485833 | 8/1925 | Fed. Rep. of Germany | 415/173.6 |
| 1300577 | 8/1969 | Fed. Rep. of Germany | 416/191 |
| 2745130 | 4/1979 | Fed. Rep. of Germany | 415/173.6 |
| 1454748 | 8/1966 | France . | |
| 2406074 | 5/1979 | France . | |
| 10179 | of 1912 | United Kingdom . | |
| 2153919A | 8/1984 | United Kingdom . | |
| 2215407A | 9/1989 | United Kingdom . | |

*Primary Examiner*—John T. Kwon

*Attorney, Agent, or Firm*—Burns, Doane, Swecker & Mathis

[57] ABSTRACT

In a device for sealing the gap between the rotor blades and the casing (2) of a turbomachine, configured with a conical profile (28), the rotor blades (6) are fitted with circumferential shroud plates (11), which seal by virtue of serrations (12, 13, 14) against the casing by the formation of radial gaps (16, 17). The tips (24, 29) of the conical ends of the blades (6) seal against the casing (2) at the inlet and outlet ends, and the shroud plate (11) located centrally at the end of the blade has three throttle locations relative to the casing, the inlet end throttle location bounding a diagonal gap (19). The end of the blade is provided with a positive offset (31) relative to the passage profile, which protrudes into a gap relief chamber (25) located in the vane carrier (2).

8 Claims, 1 Drawing Sheet

Fig. 1
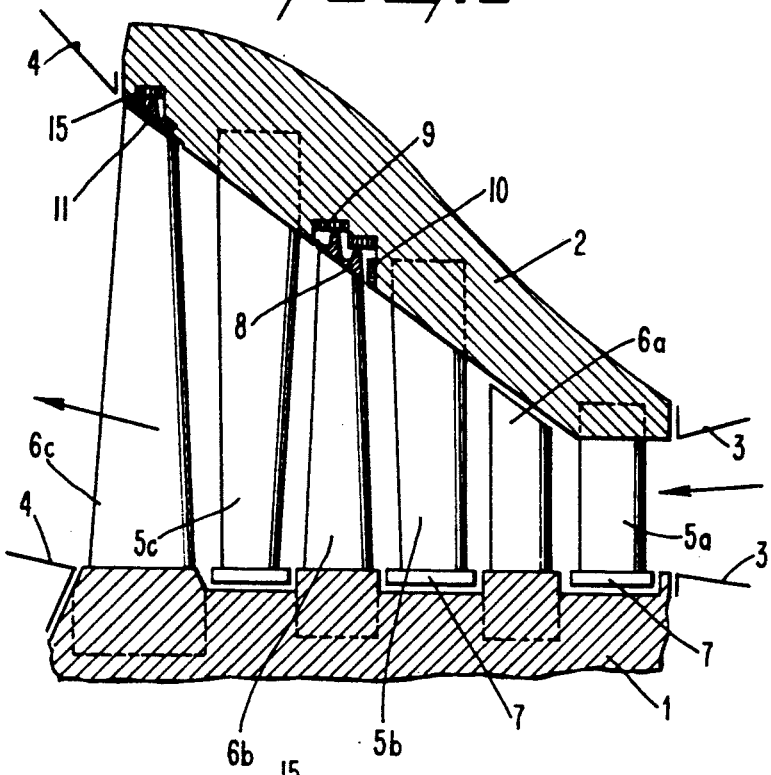
Fig. 3
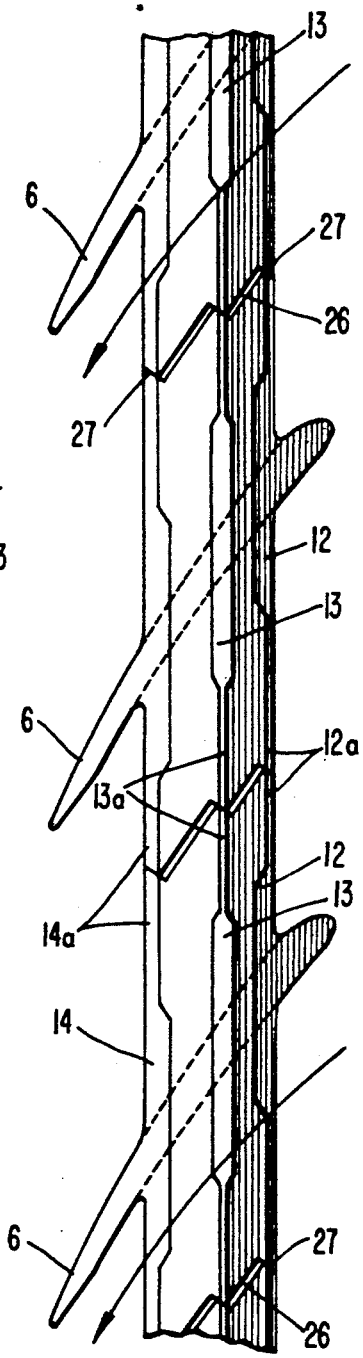
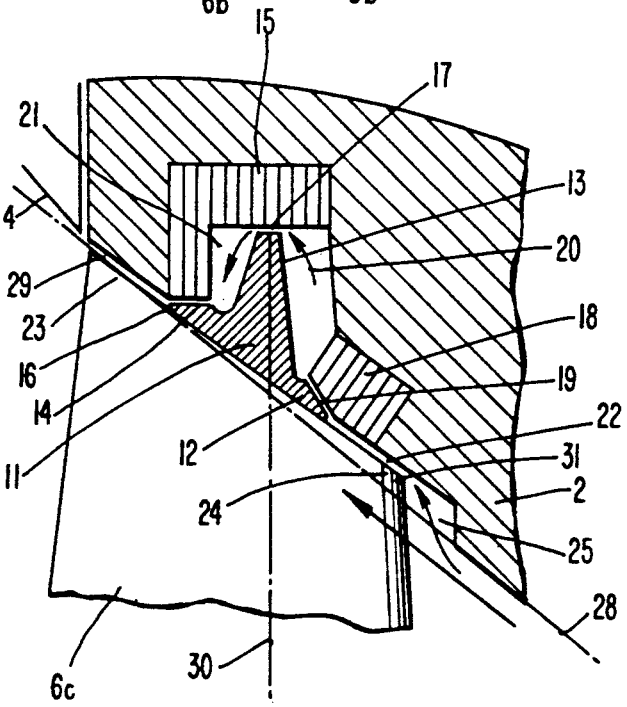
Fig. 2

SHROUD RING FOR AN AXIAL FLOW TURBINE

BACKGROUND OF THE INVENTION

1. Field of the Invention

The invention concerns a device for sealing the gap between the rotor blades and the casing of a turbomachine, configured with a conical profile, in which the rotor blades are fitted with circumferential shroud plates, which seal with serrations against the casing with the formation of radial gaps.

2. Discussion of Background

Devices of this type are known. They consist essentially of shroud plates with serrations running in the circumferential direction and sealing against the casing or against a honeycomb arrangement. In this manner they form a see-through or a stepped labyrinth with purely radial gaps. As a rule, these shroud plates extend over the whole of the blade axial chord. A known sealing configuration of this type is represented by the second stage rotor blade in FIG. 1, which will be described later. For the mechanically and/or thermally highly loaded rotor blades in the last stage of a gas turbine, for example, such a solution is no longer possible with conventional materials. Help is provided in the classical tip sealing configuration by a damping device situated in the main flow. Such a damping device, which can for example be a damping wire, is absolutely essential for free-standing long blades with low natural frequencies. However, blades with tip sealing and means for vibration prevention have the disadvantage of large energy dissipation at the damping wire and in the tip sealing configuration.

SUMMARY OF THE INVENTION

Accordingly, one object of this invention is to avoid all these disadvantages. A further object of the invention is to ensure guidance of the main flow in blades of the type referred to in the introduction.

In accordance with the invention, this is achieved by the tip of the conical end of the blades sealing against the casing at the inlet and outlet ends, and by the shroud plate, located centrally at the end of the blade, having three throttle locations relative to the casing, the inlet end throttle location forming a diagonal gap.

Amongst other advantages of the invention, it can be seen that only small gap mass flows will occur with the new sealing configuration; this is of particular importance for end stages. In this manner it is possible to achieve high efficiencies for the end stage/diffuser combination. Moreover, low frictional losses can be anticipated at high rotational speeds, as a result of the narrow shroud ring.

It is particularly useful for the shroud plates to be configured so that they are symmetrical about the axis of rotation and for the dividing lines between adjacent shroud plates to extend in the direction of the profile chord. With this configuration the unavoidable leakage flow between the shroud plates is turned into the direction of the main flow.

It is, furthermore, advantageous for the dividing line to be provided with three steps, the steps extending in the axial plane of the three throttle locations. During operation of the turbomachine, adjacent shroud plates come into contact as a result of blade untwist. This creates the necessary damping effect.

It is advantageous for the end of the blade to have a smaller hade angle than the casing profile. This hade angle should be dimensioned such that a positive offset occurs at the end of the blade with its largest value in the vicinity of the blade leading edge, which protrudes into a gap relief chamber located in the casing. This gap relief achieves a reduction of the leakage flow over the shroud ring because the main flow near the gap is diverted away from it.

If the shroud plate serration forming the central throttle location is in the axial plane of the blade's center of gravity, additional bending moments on the blade are avoided.

If, in addition, the casing at the three throttle locations is fitted with honeycomb arrangements, no damage to the highly sensitive shroud ring is to be expected in the event of a rub; these honeycomb sealing arrangements also ensure that the heat generated in the event of a rub remains as low as possible. Hence the structural properties of the highly loaded elements involved also remain intact.

Finally, it is advantageous for the serrations of the shroud plate forming the throttle locations to be tapered in the circumferential direction on the shroud plate overhangs, so as to reduce the weight of the shroud plates.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein, for an axial flow gas turbine:

FIG. 1 shows a longitudinal cross-section through the gas turbine;

FIG. 2 shows a partial section through the sealing device of the last rotor row;

FIG. 3 shows the partial development of a plan view onto the ends of the blades of the last rotor row.

DESCRIPTION OF THE PREFERRED EMBODIMENTS

Referring now to the drawings, wherein like reference numerals and letters designate identical or corresponding parts throughout the several views, only those elements essential for understanding the invention are shown. For example, the adjacent components such as the combustion chamber, outlet diffuser and blade roots, are only indicated. The blade cooling usual in this type of machine is not represented. The flow direction of the working medium is indicated by arrows.

The three-stage gas turbine in FIG. 1 consists essentially of the bladed rotor 1 and the vane carrier 2 fitted with nozzle guide vanes. The vane carrier, which exhibits a steep conical passage profile of 40°, is suspended inside a turbine casing (not shown). In what follows, the term vane carrier has the same meaning as the term casing. The working medium enters the turbine from the outlet of the combustion chamber 3. The duct through which the turbine flow passes emerges into the exhaust casing, of which only the internal walls 4 of the diffuser are shown. The blading consists of three nozzle guide vane rows 5*a*, 5*b* and 5*c* and three rotor blade rows 6*a*, 6*b* and 6*c*. The vanes of the nozzle guide vane rows seal against the rotor 1 by means of shroud rings 7. The blades of the first blade row 6*a* are free-standing; that is to say, their tips seal against the vane carrier 2. The blades of the middle blade row 6*b* are fitted with the shroud plate sealing configuration 8 referred to in the introduction and known per se. The actual sealing configuration consists of circumferential serrations, which run against a honeycomb arrangement 9. The shroud plates, extending over the whole of the blade axial chord, form a stepped labyrinth with purely radial gaps. In the present case, it is assumed that the rotor and the casing move towards each other during operation because of large relative axial expansions. For this reason, a further honeycomb arrangement 10 is fitted to the vane carrier—opposite to the inlet end part of the shroud plates—to guard against an axial rub.

The highly loaded rotor blades 6 of the outlet blade row 6c have a pitch/chord ratio of about 1 in the outer radial region. They operate with large tip rotational speeds of up to 650 m/sec in a temperature environment of up to 650° C. As shown in FIG. 2, each is fitted with a shroud plate 11 located centrally at the end of the blade and forming three throttle locations relative to the vane carrier 2. For this purpose, the plates are fitted with circumferential serrations 12, 13, 14 in three different radial planes. The outlet end serration 14, together with a honeycomb arrangement 15 set into the vane carrier 2, forms a radial gap 16. The central serration 13, which is situated in the axial plane of the blade's center of gravity 30, together with the same honeycomb arrangement 15, stepped at the corresponding position, also forms a radial gap 17. The inlet end serration 12 runs diagonally and, together with a correspondingly configured honeycomb arrangement 18, forms a diagonal gap 19. FIG. 2 shows the operating position, i.e. the position for which the diagonal gap 19 represents the operating clearance. The axial expansion is therefore used to create a throttle gap.

The three serrations enclose two vortex chambers 20, 21, which, because of the radial stagger between the throttle locations, do not affect each other. The tips 24 and 29 of the conical end of the blades seal at the inlet and outlet ends respectively against the casing. An additional throttle location 22 is therefore formed at the blade inlet by means of this tip sealing configuration. The tip sealing configuration at the outlet similarly forms an additional throttle location 23, instead of the free vortex cavities previously existing at this location, such as are formed by the shroud plate sealing configuration 8 in the middle rotor row 6b. This new type of outlet tip sealing configuration produces an outlet flow directed cleanly into the diffuser.

As shown in FIG. 2, the end of the blade is fitted with a positive offset 31 at its inlet end. This offset is formed because the blade tip hade that is, the angle the blade tip 24, 29 makes with the vertical 30, is smaller than the angle formed by the surface of the carrier 28 and the vertical 30. The offset 31 protrudes into a gap relief chamber 25 located in the vane carrier 2. To form the tip sealing configuration at this point, the inner profile of the gap relief chamber is matched to the hade of the blade tip. This unloads the blade gap aerodynamically. The pressure difference across the blade gap is lowered and the deflection is improved. The net result is a reduction in the so-called gap losses.

In FIG. 3, it can be seen that the shroud plates 11 are configured so as to be symmetrical with respect to the axis of rotation. The dividing lines 26 between adjacent shroud plates extend in the direction of the profile chord. The sides of the shroud plates in the peripheral direction are provided with three steps 27. These steps are situated in the axial planes of the three sealing serrations, in order to ensure continuous sealing at the sealing surfaces. In addition, these steps provide mechanical coupling between the shroud plates to achieve the damping effect. The serrations 12, 13 and 14 are tapered in the circumferential direction on the two overhangs of each shroud plate. These tapers 12a, 13a and 14a contribute substantially to weight saving in the shroud plates.

Obviously, numerous modifications and variations of the present invention are possible in light of the above teachings. It is therefore to be understood that within the scope of the appended claims, the invention may be practiced otherwise than as specifically described herein. As a variation of the configuration shown in FIG. 2 it could be appropriate to position the shroud plate, together with the diagonal sealing configuration, nearer to the blade leading edge and, if required, even flush with the leading edge provided structural requirements permit this.

What is claimed as new and desired to be secured by Letters Patent of the United States is:

1. A device for sealing a gap between rotor blades and a conical casing in a turbine, comprising:

a circumferential shroud plate mounted on a tip of a blade;

the shroud plate located on a central part of the blade tip so that an inlet and an outlet edge of the blade tip remain uncovered by the shroud plate;

the inlet and outlet edges of the blade tips each forming throttle locations with the casing;

the shroud plate having inlet, central, and outlet serrations extending radially from the shroud plate to the casing to form inlet, central and outlet throttle locations with the casing;

the central and outlet throttle locations being in the form of radial gaps with the casing; and, the inlet throttle location being in the form of a diagonal gap with the casing.

2. The device as claimed in claim 1, wherein the shroud plates are configured so as to be symmetrical with respect to the axis of rotation.

3. The device as claimed in claim 1, wherein the dividing lines between adjacent shroud plates extend in the direction of the profile chord.

4. The device as claimed in claim 3, wherein the dividing line is provided with three steps, one step extending in the axial plane of each of the serrations.

5. The device as claimed in claim 1, wherein the casing is provided with a gap relief chamber at the inlet edge of the blade, and the end of the blade is angled relative to the casing profile in such a way that a positive offset produced at the inlet end of the blade protrudes into the gap relief chamber.

6. The device as claimed in claim 1, wherein the shroud plate serration forming the central throttle location is situated at least approximately in the axial plane of the blade's center of gravity (16).

7. The device as claimed in claim 1, wherein the casing at the three throttle locations is fitted with honeycomb arrangements.

8. The device as claimed in claim 1, wherein the serrations of the shroud plates forming the throttle locations are tapered in the circumferential direction on the shroud plate overhangs.

* * * * *